United States Patent [19]

Town

[11] Patent Number: 4,831,667

[45] Date of Patent: May 23, 1989

[54] GLOVE AND METHOD FOR PRODUCING THE SAME

[76] Inventor: Allen W. Town, 415 W. John St., Alexandria, Ind. 46001

[21] Appl. No.: 176,360

[22] Filed: Mar. 31, 1988

[51] Int. Cl.[4] ..... A41D 19/02

[52] U.S. Cl. ..... 2/163; 2/161 R; 2/169

[58] Field of Search ..... 2/163, 161 R, 169, 159, 2/161 A

[56] References Cited

U.S. PATENT DOCUMENTS

| | | | |
|---|---|---|---|
| 3,822,417 | 7/1974 | Lars-Jos | 2/169 |
| 4,534,066 | 8/1985 | Hansson | 2/163 |
| 4,654,896 | 4/1987 | Rinehart | 2/163 |

*Primary Examiner*—Peter Nerbun

*Attorney, Agent, or Firm*—Woodard, Emhardt, Naughton, Moriarty & McNett

[57] ABSTRACT

A glove and method for manufacturing a glove which uses a plurality of panels designed and arranged to be seamed in-the-flat to each other.

14 Claims, 5 Drawing Sheets

GLOVE AND METHOD FOR PRODUCING THE SAME

BACKGROUND OF THE INVENTION

1. Field of the Invention:

This invention relates generally to gloves and a method for producing a glove and more particularly to a glove wherein all of the panels are designed to be seamed in-the-flat to their adjacent panels to provide a glove having a roomy but proper fit in both the fingers, thumb and the palm.

2. Description of the Prior Art:

While many forms of glove construction have existed over the years which provide a comfortable fit to the hand, none of these constructions lend themselves readily, if at all, to automatic seaming techniques. Historically glove making has required the use of skilled labor to manufacture and seam together the various complicated uneven panels of patterns which provide a comfortable fit. Most glove patterns now in use do not lend themselves well, if at all, to automatic seaming methods. Additionally, those glove patterns which can easily be automatically seamed do not provide a comfortable fit in all of the portions of the glove. Among the common glove patterns are the Clute Cut Pattern, Gunn Cut Pattern, Fourchette or Montpelier Pattern and the Flat Pattern.

The Clute Cut Pattern provides roominess in the finger for good fit by wrapping material around the back or dorsal part of the finger. The front or palmar panel of the finger is cut to a width that approximates the width of the finger plus desired clearances, while the back or dorsal panel of the finger must be cut to a width that approximates the width as well as two thicknesses of the finger plus desired clearances. The discrepancy in the widths of the dorsal finger panel and the palmar finger panel requires that the edges of the dorsal panel be carefully placed together with the edges of the palmar finger panel when it is sewn to the palmar finger panel. This alignment of the edges precludes automatic seaming of the finger panels and necessitates the use of skilled labor in assembling the glove.

The Gunn Cut Pattern provides roominess in the finger for good fit by wrapping material around the front of the finger rather than the back of the finger as is done in the Clute Cut Pattern. The Gunn Cut Pattern suffers from similar problems in assembly as the Clute Cut Pattern.

In the Fourchette or Montpelier Pattern roominess in the finger for good fit is provided by material being equally divided more or less between the palm, back and sides of the fingers. This pattern has many panels which must be seamed together to form the glove and thus precludes manufacture by seaming in-the-flat.

In the Flat Pattern the palmar and dorsal panels are the same size. Flat Pattern gloves are seamed together in-the-flat. The front and back panels of the Flat Pattern are each single whole pieces and are generally mirror images of one another. There is a disadvantage of this Flat Pattern in that it compromises the fit of the glove primarily between the fingers and the palm and back to achieve the best fit for each that the pattern will allow. The quality of the fit is limited by the fact that each half finger portion must have a width at its base and throughout its length that approximates half of the circumference of the finger plus desired clearance and seam widths in order to properly fit the finger. Thus the width of each panel at the base of the fingers approximates half of the sum of the circumference of each of the fingers plus desired clearances and eight seam widths, whereas the width of material required to cover the palm of the hand at the base of the fingers is only approximately the sum of the width of the fingers plus desired clearances and two seam widths. Therefore, if the Flat Pattern is used, the width of each panel at the base of the fingers includes much more material than is required to enclose the palm of back of the hand. This additional material gathers in the palm or back of the glove.

From the foregoing it should be readily apparent that although the Flat Pattern using a unitary dorsal panel and a mirror image unitary palmar panel, may be easily seamed in-the-flat (allowing for automatic seaming) the fit of the glove must be compromised by either having the palm of the glove fit too loosely if the fingers fit properly or by having the fingers fit too tightly if the palm fits properly.

One patent which is believed to be relevant to the fingers portion of the disclosed glove is the patent to Rinehart (U.S. Pat. No. 4,654,896 issued Apr. 7, 1987). Rinehart discloses finger portions to a glove which are designed to be seamed in-the-flat to each other and also seamed in-the-flat to the palm and back portions of a glove. Rinehart does not disclose thumb, palm, and back portions which may be seamed in-the-flat to provide an entire glove which may be seamed in-the-flat. The star-shaped pattern disclosed in Rinehart will result in less efficient material utilization than the disclosed invention when several panels are cut from a sheet of material. Additionally, the rectangular cut-out forming the line-junction edge will result in the line junction edge having small indentations concentration at each interior corner of the cut out when straightened. These concentrated indentations might result in gaps between the fingers and the remainder of the glove if the seaming of these pieces is not tightly controlled. These gaps would destroy the integrity of the glove, and result in a defective seam. These indentations require additional care in alignment of the adjacent seam edges to insure that the seam widths are maintained consistently throughout to their proper widths. This need to tight control of the seaming would complicate automated glove construction.

The prior glove patterns suffers from either requiring skilled labor to construct a well fitting glove or by comprising fit when the pattern allows for automated seaming.

SUMMARY OF THE INVENTION

The glove according to this invention is characterized by a plurality of panels which may be seamed together in-the-flat to form a hand covering which properly fits both the palm, thumb and the fingers of the hand. The glove has a dorsal fingers panel and a palmar fingers panel which have finger peripheral edges which are substantially mirror images of one another. Both fingers panels have a peripheral edge, an index finger side edge and a small finger side edge which combine to define a plurality of half-fingers. Both fingers panels also have a line junction edge for connection to the palm, back of the thumb and back panels of the glove. Because the finger peripheral edges of both fingers panels are mirror images of one another they may be seamed together in-the-flat when they are in a first and a second flat state, respectively. While in the first flat state the line junction edge assumes a first smoothly curved geometrical configuration. In a second non-flat state the line junction edge assumes a second smoothly curved geometrical configuration which assumes the same geometrical configuration as the line junction edge of the palm, back of thumb or back panel to which the fingers panel is to be seamed thereby allowing the fingers panels to be seamed in-the-flat to the palm, thumb and back panels. Also, the palm, back of thumb and back panels are designed and arranged to be seamed to each other in-the-flat.

In a further embodiment of the invention the palm/-thumb panel is two panels each of which define a half thumb portion with thumb peripheral edges which are mirror images of each other to allow seaming in the flat.

A second embodiment of this invention is a method for manufacturing a glove which comprises the steps of providing two fingers panels with mirror image peripheral edges (one dorsal and one palmar), a back panel and a front panel and seaming the fingers panels together in-the-flat, seaming the back panel in the flat to the dorsal fingers panel, seaming the front panel in-the-flat to the palmar fingers panel and seaming the back panel in-the-flat to the front panel.

DESCRIPTION OF THE PREFERRED EMBODIMENT

Figure 1:
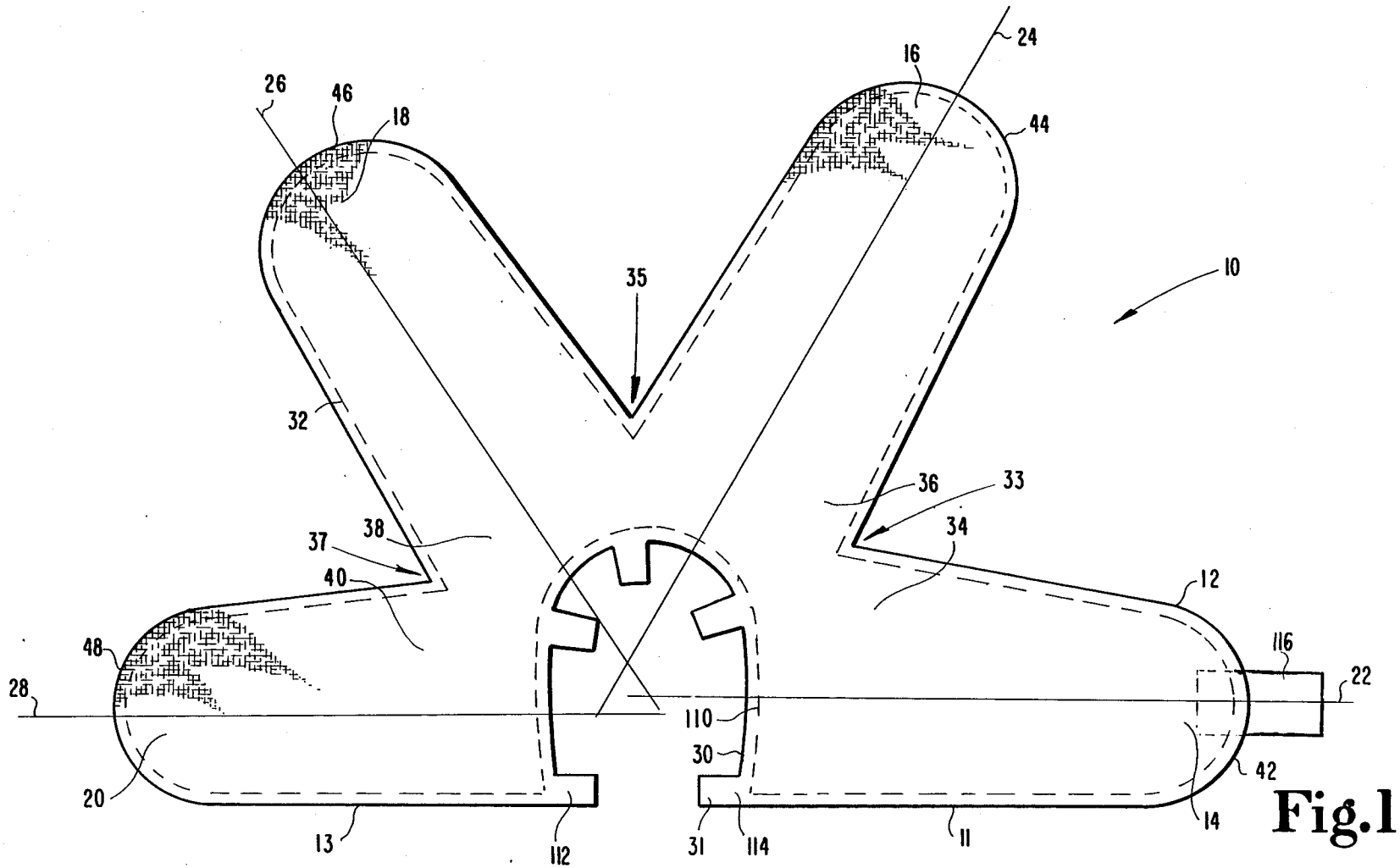
FIG. 1 depicts a dorsal fingers panel in a first flat configuration for a glove according to the present invention.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 depicts a dorsal fingers panel 10 in a first flat configuration. The preferred embodiment of the present invention uses dorsal fingers panels 10 and palmar fingers panels 10' which are mirror images of one another at least around their respective peripheral edges 12 and 12'. Therefore, often only the dorsal fingers panel is described with the understanding that the palmar fingers panel is substantially a mirror image of the dorsal fingers panel. Also, occasionally the term "fingers panels" will be used to refer to both the dorsal fingers panel and the palmar fingers panel. Whenever it is necessary in describing the invention to distinguish the dorsal fingers panel from the palmar fingers panel, primed numbers will be used with regard to the palmar fingers panel 10'. Also, occasionally a primed number will not appear on FIG. 2 but an analogous unprimed number will appear on FIG. 1 with the understanding that an analogous element is embodied in FIG. 2.

Additionally, when those panels used to construct a glove to fit the right hand of a wearer are illustrated and described, it should be understood that a glove to fit the left hand may be manufactured with panels which are mirror images of the illustrated panels and vice versa.

Also when the dorsal fingers portion has an element described in the specification and/or the claims as a "first" element, the palmar fingers portion will have an analogous element which may be described in the specification and/or the claims as a "second", "third" or "foruth" element.

One further complication which arises in describing the panels is that gloves are typically seamed together inside-out and then turned inside-out so that the seams and additional material necessary to form the seam are in-seam and hidden. A glove which fits the right hand when the seams are out, fits the left hand when the seams are hidden. Therefore, FIG. 1 illustrates the left hand dorsal fingers panel in an out-seam construction and the mirror image of the right hand dorsal fingers panel in an out-seam construction. FIG. 1 also represents the mirror image of the left hand dorsal fingers panel in an in-seam construction, and the right hand dorsal fingers panel in an in-seam construction.

Figure 8:
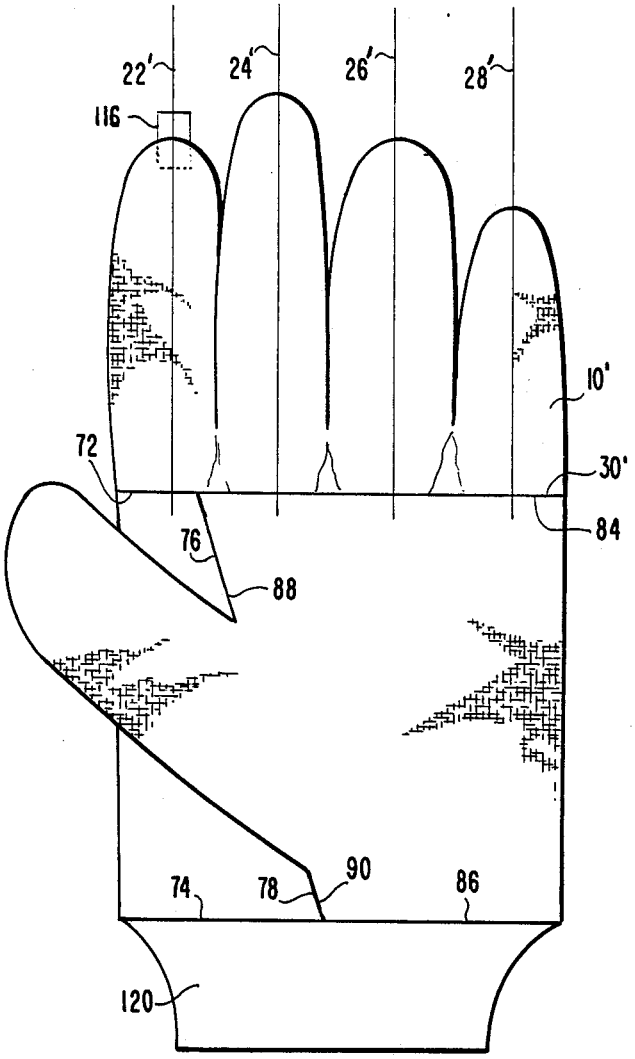
FIG. 8 depicts a view of the palm of a completed glove according to the present invention.

The dorsal fingers panel 10 has a first peripheral edge 12, an index finger side edge 11 and a small finger side edge 13 which define a plurality of half-finger portions including the index finger half-finger portion 14, middle finger half-finger portion 16, ring finger half-finger portion 18 and small finger half-finger portion 20. Index finger half-finger portion 14 has a longitudinal axis 22 about which it is substantially symmetrical, middle finger half finger portion 16 has a longitudinal axis 24 about which it is substantially symmetrical, ring finger half-finger portion 18 has a longitudinal axis 26 about which it is substantially symmetrical and small finger half-finger portion 20 has a longitudinal axis 28 about which it is substantially symmetrical. While the fingers panels are in a flat state, the various longitudinal axes 22, 24, 26, 28 diverge as they extend further from the panel. However, when the glove is assembled (see FIG. 8) or in a non-flat stae, the longitudinal axes 22, 24, 26 and 28 may be parallel to one another. It is the divergence of the longitudinal axes 22, 24, 26, 28 which allows the fingers panel to be fabricated with a line junction edge 30 that is concavely curved when the fingers panel is in a flat state. The divergence of the axes allows each individual half-finger portion to be fabricated wide enough to provide a comfortable fit to the individual finger to be enclosed therein while allowing the line junction edge 30 to have a peripheral measurement which is approximately equal to the measurement of the material used to enclose half of the hand as will be further explained hereinafter.

The diverging longitudinal axes permits the half-finger portion 14, 16, 18 and 20 to be cut from fabric with the proximal ends 34, 36, 38 and 40 respectively of each half-finger portion touching the adjacent half-finger portion while the distal end 42, 44, 46 and 48 respectively of each half-finger portion is separated from the distal end of its adjacent half-finger portion. Each single finger panel may be fabricated at the minimum from any shaped piece of fabric which would allow the divergence of the longitudinal axes while providing material of sufficient width around the longitudinal axes to cut the half-fingers portions. However, typically several panels are laid out on a flat piece of material with each panel positioned to provide for best material utilization.

Figure 2:
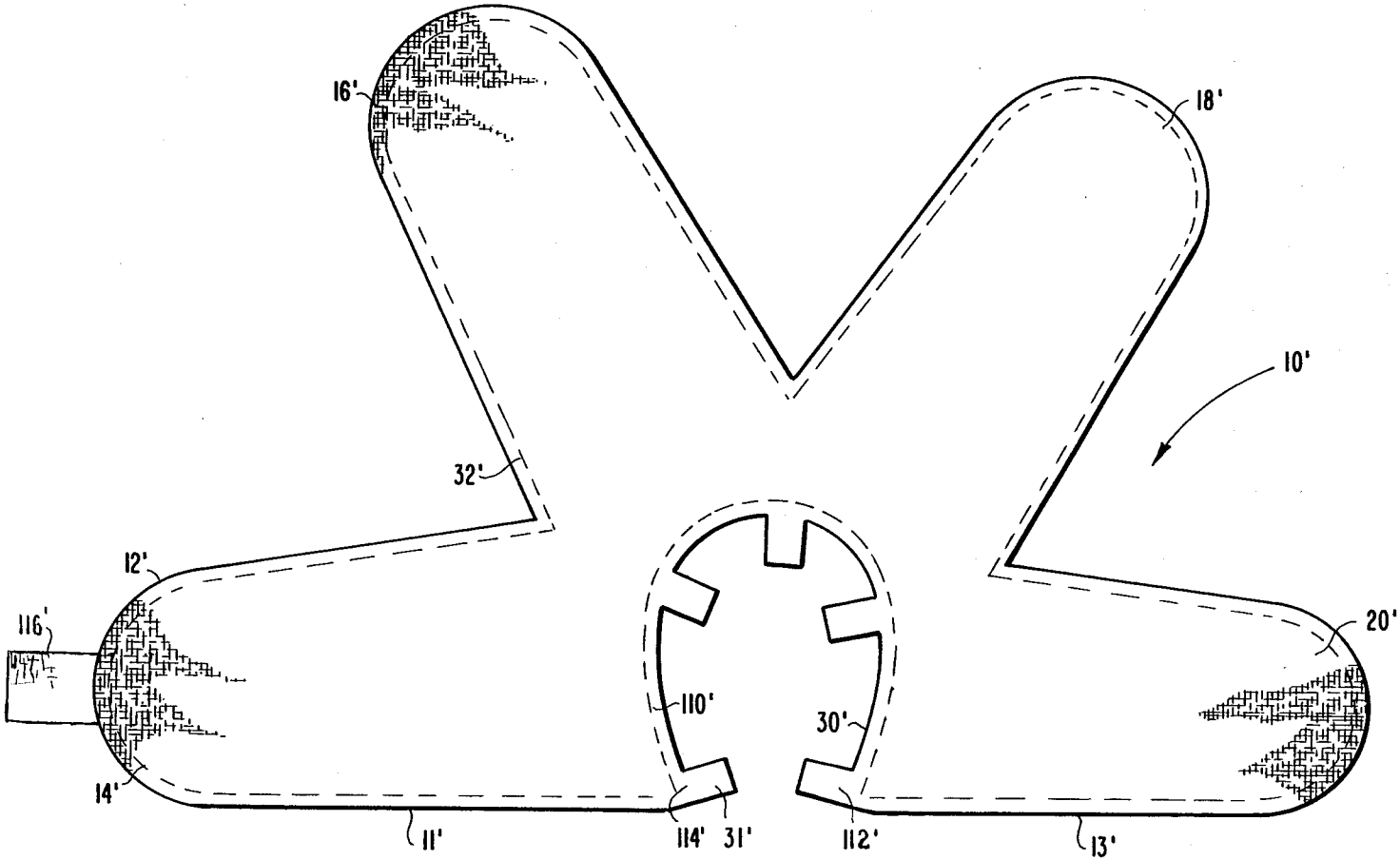
FIG. 2 depicts the palmar fingers panel in a second flat state for a glove according to the present invention.

FIG. 1 is referred to for purposes of explanation. As can be seen in FIG. 1 the longitudinal axes 22, 24, 26 and 28 diverge as they extend proximally to distally. Each longitudinal axis extends at approximately a 60 degree angle from its adjacent longitudinal axes but such an angle is not critical. While the panel is described as if it were cut from a flat piece of fabric, in fact the panel may be fabricated to the desired shape in any appropriate manner. Naturally those skilled in the art to which this invention relates will understand that FIGS. 1 and 2 are not precise patterns for the disclosed fingers panels 10 and 10', but are merely tools used to more easily describe the fingers panels. However, FIGS. 1 and 2 may be easily modified to properly fit the human hand.

The dashed line 32 in FIG. 1 near the peripheral edge 12, index finger side edge 11 and small finger side edge 13 of the fingers panel 10 illustrates the seam which will join the dorsal fingers panel 10 and the palmar fingers panel 10' together. Thus when forming the fingers panels it is necessary to provide additional material so that the panels may be seamed together. For instance, each index finger half-finger portion 14 and 14' must have a width which is sufficient to enclose half the circumference of the index finger and two seam widths plus clearance for the desired fit.

The widths of the remaining half-finger portions will likewise depend upon the circumference of the finger to be enclosed and the seam widths plus desired clearances.

Those of ordinary skill in the art of glove making will understand that the above widths may be modified depending on the tightness or looseness of the fit desired and the material used to manufacture the glove. For instance, the previously described widths will typically be increased slightly to provide some room in the glove to allow for normal finger manipulation. However the previously described measurements may be decreased slightly if the glove is manufactured from an elastic material and a tight fit is desired.

Each half-finger portion 14, 16, 18 and 20 is fabricated with a length sufficient to enclose the finger it is designed to fit. The half-fingers portions are generally symmetrical about their respective longitudinal axes 22, 24, 26 and 28 and may be rounded near the distal ends 42, 44, 46 and 48. The peripheral edge 12 forms three V-shaped crotches 33, 35 and 37 because the proximal ends 34, 36, 38 and 40 of each half-finger portion touches the proximal end of the adjacent half-finger portion while the distal ends 42, 44, 46 and 48 of each half-finger portion are separated from the distal end of the adjacent half-finger portion. These crotches 33, 35 and 37 should be displaced distally from the line junction edge 30 to provide sufficient material in the half fingers portions to allow for the thickness of the hand and for seaming of the panels together to form fingers portions that will properly fit the fingers of a human hand. The seam 32 used to join the mirror image fingers panels together follows the same shape as the peripheral edge 12. The points where the base of the V-shapes in the seam meet all lie sufficiently distally from the line junction edge 30 to provide sufficient material to semi-enclos hand. fingers plus desired clearances.

A plurality of tabs 31 extend from the line junction edge 30 to aid in automatic assembly of the glove. Tabs 31 may be grabbed by an automatic assembly device to aid in changing the shape of the line junction edge 30 from its first smoothly curved geometric configuration to a second smoothly curved geometrical configuration which matches the geometrical configuration of the junction edge of the remainder of the glove.

Figure 4:
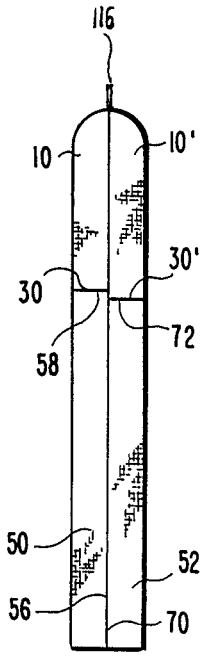
FIG. 4 depicts a side view of the index finger side of the glove (without thumb) according to one embodiment of the present invention.
Figure 3:
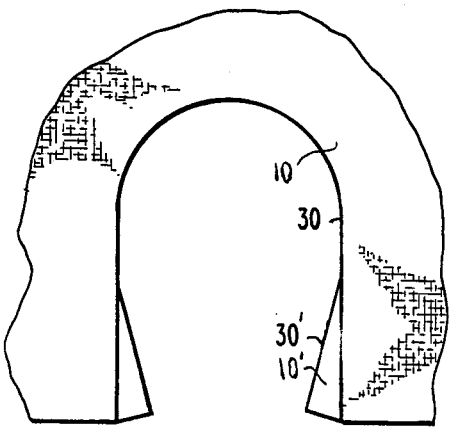
FIG. 3 depicts the line junction edges of the dorsal and palmar fingers panels (without tabs) when the dorsal fingers panel is placed on the palmar fingers panel.

A smoothly curved line junction edge 30 is cut from the fabric or otherwise formed. The measurement around the line junction edge 30 should be the same as the width of the material necessary to enclose half of the palm plus desired clearance and seam widths. In FIG. 1 the line junction edge 30 consists of a curved section and two extension sections extending from the ends of the curved section. The total length of the line junction edge 30 is the same as the length of material required to semi-enclose the palm of the hand plus seam widths and desired clearances. In FIG. 2 the line junction edge 30' consists of a single irregularly curved section. FIG. 3 shows a partial overlay of the dorsal fingers panel 10 and the palmar fingers panel 10' (without tabs) showing how the shapes of line junction edges 30 and 30' differ. Although the entire dorsal fingers panel and palmar fingers panel may be mirror images of one another, the illustrated and described differences in the shapes of line junction edges 30 and 30' has the benefit of off-setting the seams which connect the fingers panels to the remainder of the glove as illustrated in FIG. 4. Even though the shapes of line junction edges 30 and 30' differs, the lengths of the line junction edges 30 and 30' are the same.

The divergence of at least two longitudinal axes of the half-fingers is required to manufacture the fingers panels of a glove according to the present invention. Also, each fingers panel 10 need not be fabricated from a unitary piece of material, but instead several individual panels which will form a fingers panel as described are within the scope of the invention so long as these individual panels may be seamed together in-the-flat. Additionally, it should be stressed that FIGS. 1 and 2 illustrates the fingers panel in a flat state.

Figure 5:
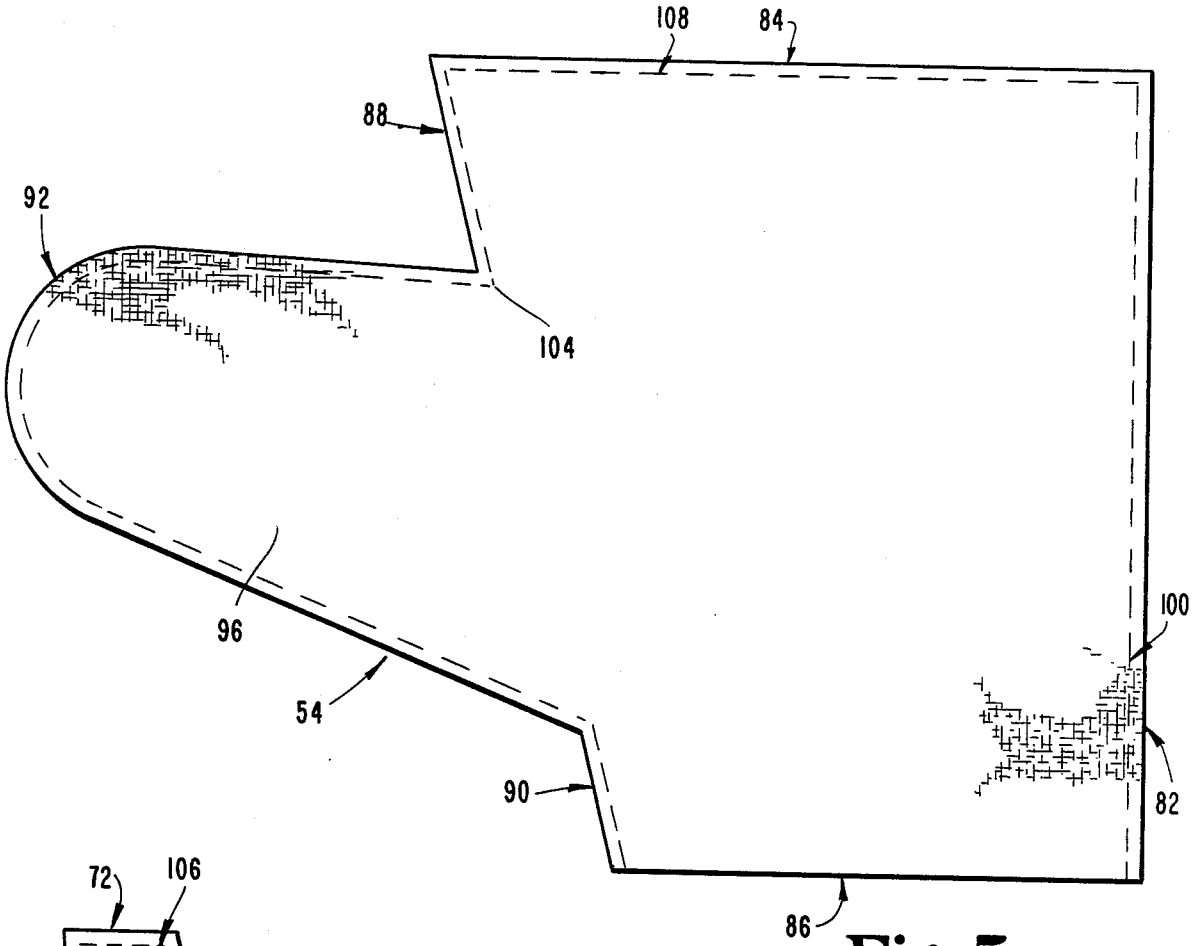
FIG. 5 depicts a palm panel with the face side of half thumb according to the present invention.
Figure 6:
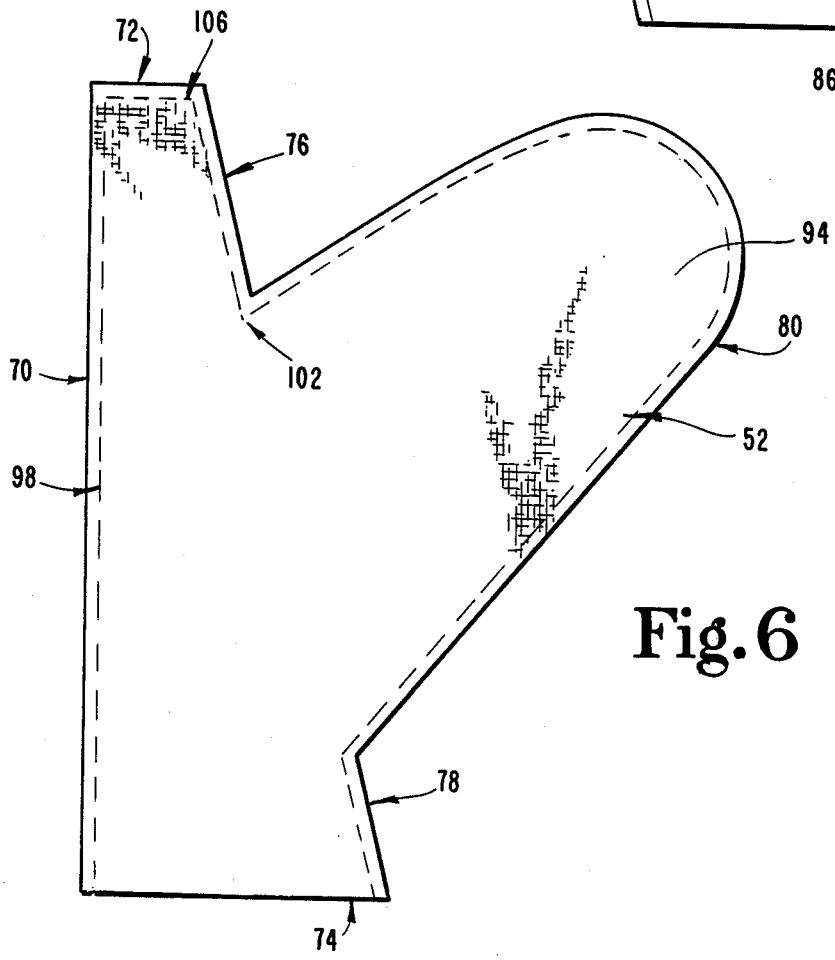
FIG. 6 depicts the back of a thumb panel for a glove according to the present invention.
Figure 7:
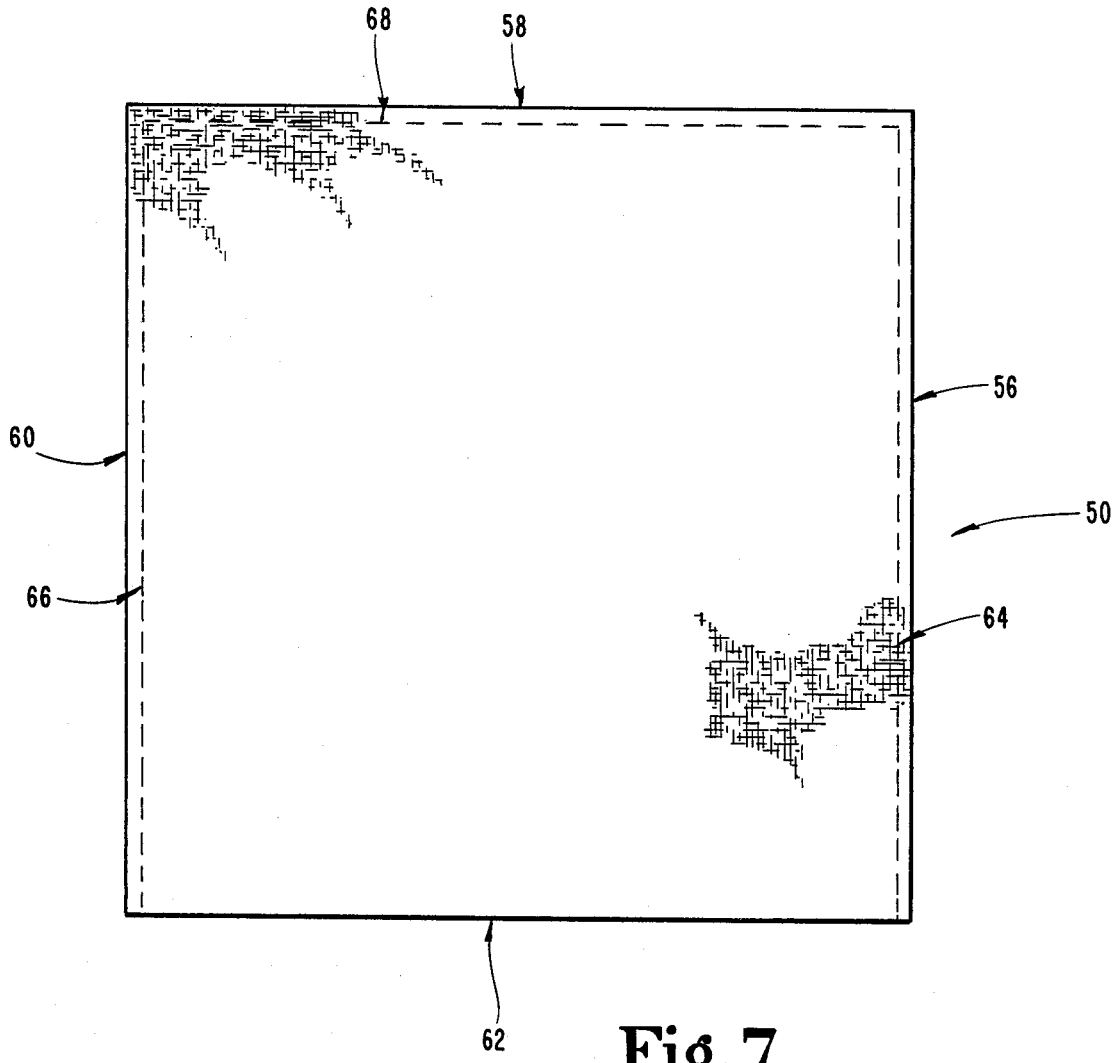
FIG. 7 depicts a back panel for a glove according to the present invention.

FIGS. 5–7 illustrate the remaining panels of a glove according to the present invention. Back panel 50 (FIG. 7), back of thumb panel 52 (FIG. 6) and palm panel 54 (FIG. 5) are designed and arranged to be seamed in-the-flat to each other and properly fit the thumb and the non-fingers portions of the hand. There may be several different combinations of panels which could be used to form the lower section of the glove, but FIGS. 5–7 illustrate the preferred embodiment.

Referring first to FIG. 7, back panel 50 of a glove is illustrated. Back panel 50 has a first or index finger side edge 56, a second or small finger side edge 60, a line junction edge 58 and a bottom opening edge 62. The first side edge 56 and second side edge 60 are of sufficient length to cover a hand from approximately the base of the fingers to the wrist. Naturally if greater or lesser coverage is desired, the length of the respective side edges could be increased or decreased as appropriate. The dashed lines 64 and 66 along the side edges represent seams which connect the back panel 50 to the back of thumb panel 52 and palm panel 54 when the glove is assembled. The line junction edge 58 is substantially linear and is of a width sufficient to halfway encompass the non-fingers portion of a hand. However, it should be understood that the line junction edge 58 may be curved so long as the line junction edge 30 of the dorsal fingers panel 10 may assume the same curve. This width is the same measurement as the measurement of the line junction edge 30 of the dorsal fingers panel 10 to facilitate seaming together of the back panel 50 and the dorsal fingers panel 10. Dashed line 68 represents the seam connecting the back section 50 to the dorsal fingers panel 10 in the finished glove. As can be seen in FIG. 7, bottom opening edge 62 is left open to facilitate insertion of a hand into the finished glove. Back panel 50 has a substantially rectangular shape when in a flat state.

Referring to FIGS. 5 and 6, back of thumb panel 52 and palm panel 54 are illustrated. Back of thumb panel 52 and palm panel 54 are most easily described together with the description of the back panel 50 kept in mind. Back of thumb panel 52 has a linear side edge of index finger side edge 70, a line junction edge 72, a bottom opening edge 74, a distal transpalmar linear edge 76, a proximate transpalmar linear edge 78 and a back of thumb peripheral edge 80. Palm panel 54 likewise has a linear side edge or small finger side edge 82, a line junction edge 84, a bottom opening edge 86, a distal transpalmar linear edge 88, a proximate transpalmar lineare edge 90 and a half-thumb peripheral edge 92. The half-thumb peripheral edges 80 and 92 define half-thumb portions 94 and 96 in the back of thumb panel 52 and the palm panel 54 respectively. Half-thumb portion 94 and 96 are each of an appropriate size to semi-enclose a thumb of the hand to be inserted into the glove with sufficient additional material for the seams and desired clearance. Half-thumb portions 94 and 96 and extend angularly from the transpalmar linear edges 76 and 78 and 88 and 90 of the generally trapezoidally shaped remainders of thumb panel 52 and palm panel 54 respectively. The transpalmar linear edges and half-thumb peripheral edges of the palm panel and back of thumb panel are mirror images of each other to facilitate seaming these panels together in-the-flat.

Linear side edges 70 and 82 are of substantially the same length as the linear side edges 56 and 60 of the back panel 50 to which they will be seamed. However, the lengths of linear side edges 70 and 82 will be slightly less than the lengths of linear side edges 56 and 60 when the line junction edges 30 and 30' of the fingers panels 10 and 10' are of a different shape so that the seams connecting the fingers panels to the back of thumb, palm and back panels will be slightly displaced as illustrated in FIG. 4. The seams for connecting the linear side edges 70 and 82 to the linear side edges 56 and 60 of the back panel 50 are represented by dashed lines 98 and 100. When back of thumb panel 52 and palm panel 54 are seamed together along the dashed lines 102 and 104 following the distal transpalmar linear edges 76 and 88, half-thumb peripheral edges 80 and 92 and proximate transpalmar linear edges 78 and 90, a single line junction edge is formed. This single line junction edge formed by line junction edges 72 and 84 is the same length as the line junction edge 30' of palmar fingers panel 10'. The single line junction edge formed by line junction edges 72 and 84 is seamed along dashed lines 106 and 108 to the line junction edge 30' of palmar fingers panel 10'. Bottom opening edges 74 and 86 are not seamed to bottom opening edge 62 of the back panel thereby defining a bottom opening for insertion of a hand when the glove is assembled.

The various panels of the glove may be assembled in any manner which allows for automated seaming. Automated seaming is facilitated when there is no need to gather any material along the seam line. Thus while the material in the glove may gather at a point away from the seam, the material at the actual seam line must lie flat against the material to which it is to be seamed during the seaming operation. That is what is meant by seaming in-the-flat. The preferred method for seaming the previously described panels together is therefore described hereafter.

If any of the five panels disclosed previously, i.e. dorsal fingers panel 10, palmar fingers panel 10', back panel 50, thumb panel 52 and palm panel 54, were not manufactured in a unitary panel, then the various pieces used to form the described panels should be assembled to form the five panels. Dorsal fingers panel 10 and palmar fingers panel 10' are seamed together along peripheral edges 12 and 12' as represented by the appropriate portions of dashed lines 32 and 32'. This seam connects the fingers panels 10 and 10' together around the entire peripheral edges 12 and 12'. Portions of the index finger side edges 11 and 11' and the small finger side edges 13 and 13' nearest to line junction edges 30 and 30' are not connected at this time to facilitate later seaming of the fingers panels to the remainder of the glove. Thus those portions of dashed lines 32 and 32' that are adjacent to side edges 11 and 13 and near line junction edges 30 and 30' are not seamed in this operation. The dorsal fingers panel and palmar fingers panel can be placed on top of one another, with the peripheral edges aligned. This seaming process can be accomplished with no gathering of the material in either panel and with each panel in a flat state during the seaming because the peripheral edges of the panels are mirror images of each other.

Back of thumb panel 52 and palm panel 54 are seamed together along the dashed lines 102 and 104 following the distal transpalmar linear edges 76 and 88, half-thumb peripheral edges 80 and 92 and proximate transpalmar linear edges 78 and 90. This seaming process can be accomplished with no gathering of the material in either panel and with each panel in a flat state during the seaming because the half-thumb portions 94 and 96 are mirror images of each other, distal transpalmar linear edges 76 and 88 are the same length as each other and proximate transpalmar linear edges 78 and 90 are the same length as each other.

The combined palm panel 54 and back of thumb panel 52 may then be seamed along the single line junction edge formed by line junction edges 72 and 84 to line junction edge 30' in palmar fingers panel 10'. This seam is represented by dashed lines 110', 106 and 108. In order to perform this seaming operation it is necessary to change the shape of line junction edge 30' from the curved shape it assumes when it is in a flat state to a shape that matches the shape of the single line junction edge formed by line junction edges 72 and 84. In the disclosed panels, as illustrated, the change in the shape of the line junction edge 30' may be accomplished by pulling opposite corners 112' and 114' away from each other so that the line junction edge assumes a straight line configuration. This shape changing operation will result in material gathering in the palmar fingers panel near crotches 33, 35, and 37, but there will be no gathering of material along line junction edge 30' (see FIG. 8).

Therefore, although palmar fingers panel 10' will be in a non-flat state, the seaming operation may be accomplished in-the-flat because there if no gathering of material along line junction edge 30'.

Back panel 50 is seamed along line junction edge 58 to the dorsal fingers panel 10 along line junction edge 30. This seam is represented by dashed lines 68 and 110. In order to perform this seaming operation it is necessary to change the shape of line junction edge 30 from the curved shape it assumes when it is in a flat state to a shape that matches the shape of the line junction edge 58. In the disclosed panels, as illustrated, the change in the shape of the line junction edge 30 may be accomplished by pulling opposite corners 112 and 114 away from each other so that the line junction edge assumes a straight line configuration. This shape changing operation is the same as the operation performed to the palmar fingers panel 10'.

After the previous operations are completed the index finger side edges 56 and 70 of the back and back of thumb panels 50 and 52 are seamed together as are the small finger side edges 60 and 82 of the back and palm panels 50 and 54. During the same seaming operation, the previously unseamed portions of small finger side edge 13 and 13' and index finger side edges 11 and 11' are seamed together to form the completed glove. These seams are represented by dashed lines 64, 66, 98, 100 and the portions of dashed line 32 adjacent index finger side edge 11 and small finger side edge 13 near line junction edges 30 and 30'. The seaming is accomplished in-the-flat. An elastic closure band 120 or other type of cuff may be seamed to the bottom opening edges, as in FIG. 8, if such is desired, however it is of no significance to the present invention. Finally, if an inseam construction is desired, the glove may be turned inside out. Additionally, if a waterproof glove is desired, the glove may be dipped in or sprayed with an appropriate plastic, rubber or other waterproofing solution if the glove was not made of waterproof material and construction.

If the assembled glove is to be used as a waterproof liner for a glove, attachment tabs 116 (FIGS. 1, 2, 4 and 8) may be inserted between various panels to be seamed together prior to the seaming operation. Upon seaming of the liner, the liner will become watertight and this watertight integrity can be maintained by seaming the attachment tab 116 to the outer glove as opposed to seaming the liner directly to the glove. Attachment tabs 116 may be located at any appropriate portion in the glove.

Throughout this application the term seaming has been used instead of sewing. The term seaming has been used because the design of this glove allows the panels to be seamed together not only by the traditional needle and thred sewing method, but also by welding, heat-sealing, ultra-sonic sealing, Rf sealing, stapling, stitching, sealing, etc. For instance, the disclosed pattern has a distinct and definite application in a glove which has a waterproof or a waterproof breathable specification and also requires a proper hand fit configuration. The disclosed pattern when used with sealable materials, with seams continuously sealed together, results in a continuous whole glove which avoids the stitching needle holes that are common in the ordinary sewing means now used in stitching construction. The stitching construction requires additional operations to seal off the needle holes and seam to make the glove waterproof. This is done by taping the seams, applying a sealant to the seams or other common methods, none of which are as reliable as heat-seal seaming.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A hand covering comprising:

a dorsal fingers panel having a first peripheral edge and a first line junction edge, said first peripheral edge defining a first plurality of half-fingers, said dorsal fingers panel having a first flat state wherein said first line junction edge assumes a first smoothly curved geometrical configuration and a first non-flat state wherein said first line junction edge assumes a second straight geometrical configuration;

a palmar fingers panel having a second peripheral edge and a second line junction edge, said second peripheral edge defining a second plurality of half-fingers, said palmar fingers panel having a second flat state wherein said second line junction edge assumes a third smoothly curved geometrical configuration and a second non-flat state wherein said second line junction edge assumes a fourth straight geometrical configuration, wherein said second peripheral edge of said palmar fingers panel is connected to said first peripheral edge of said dorsal fingers panel to define a plurality of fingers designed and arranged to receive the fingers of a human hand; and a third portion designed and arranged to receive the thumb, back and palm of a human hand, said third portion having a palmar line junction edge which in a third flat state assumes said fourth straight geometrical configuration and a dorsal line junction edge which in a fourth flat state assumes said second straight geometrical configuration, wherein said dorsal line junction edge is connected to said first line junction edge and said palmar line junction edge is connected to said second line junction edge.

2. The handcovering of claim 1 wherein said second peripheral edge is substantially a mirror image of said first peripheral edge.

3. The handcovering of claim 1 wherein each of said first plurality of half-fingers has a longitudinal axis, a distal end and a proximate end and wherein two longitudinal axes diverge as they extend distally when said dorsal fingers panel is in said first flat state.

4. The handcovering of claim 3 wherein said second peripheral edge is substantially a mirror image of said first peripheral edge.

5. The handcovering of claim 1 wherein said third portion comprises:

a back panel having said dorsal line junction edge;

a back of thumb panel having a thumb panel line junction edge, a first transpalmar edge and a first half-thumb peripheral edge, said first half-thumb peripheral edge defining a first half-thumb portion;

a palm panel having a palm panel line junction edge, a second transpalmar edge and a second half-thumb peripheral edge, said second half-thumb peripheral edge defining a second half-thumb portion;

wherein the second transpalmar edge and said second half-thumb peripheral edge are mirror images of said first transpalmar edge and said first half-thumb peripheral edge and wherein further said palm panel is connected to said thumb panel along said first and second transpalmar edges and said first and second half-thumb peripheral edges so that said thumb panel line junction edge and said palm panel line junction edge define said palmar line junction ege; and, wherein said palm panel, said thumb panel and said back panel are connected to define said third portion.

6. The handcovering of claim 1 wherein said first line junction edge assumes a concavely curved configuration when said dorsal fingers panel is in said first flat state, said first line junction edge assumes a substantially straight line configuration when said dorsal fingers panel is in said first non-flat state, said second line junction edge assumes a concavely curved configuration when said palmar fingers panel is in said second flat state, said second line junction edge assumes a substantially straight line configuration when said palmar fingers panel is in said second non-flat state, said palmar line junction edge assumes a substantially straight line configuration when in said third flat state and said dorsal line junction edge assumes a substantially straight line configuration when in said fourth flat state.

7. The handcovering of claim 6 wherein each of said first plurality of half-fingers has a longitudinal axis, a distal end and a proximate end and wherein each of said longitudinal axes diverge as they extend distally when said dorsal fingers panel is in said first flat state.

8. The handcovering of claim 6 wherein said first line junction edge and said dorsal line junction edge are approximately the same length and said second line junction edge and said palmar line junction edge are approximately the same length.

9. A handcovering providing a roomy but proper fit to the fingers and palm of a human hand comprising:

a dorsal fingers panel having a line junction edge and a peripheral edge, said line junction edge being of a sufficient length to semi-enclose the palm of said hand, said peripheral edge defining a plurality of half-fingers portions, each of said half-fingers portions having a longitudinal axis, a distal end, a proximate end and a width sufficient to semi-enclose a finger of said hand, wherein said dorsal fingers panel may assume a flat state wherein said line junction edge is concavely curved and said longitudinal axes diverge as they extend distally and a non-flat state wherein said line junction edge is substantially straight and said longitudinal axes extend substantially parallel to each other;

a palmar fingers panel which is a mirror image of said dorsal fingers panel, said palmar fingers panel being designed and arranged to be seamed in the flat around said peripheral edge to said dorsal fingers panel when said dorsal fingers panel and said palmar fingers panel is in said flat state;

a back panel which in a third flat state has a first side edge, a second side edge and a dorsal line junction edge, said dorsal line junction edge being substantially straight and being designed and arranged to be seamed in-the-flat to said line junction edge of said dorsal fingers panel when said dorsal fingers panel is in said non-flat state and when said back panel is in said third flat state;

a back of thumb panel which in a fourth flat state has a third side edge, a first half-thumb peripheral edge and a first partial palmar line junction edge, said third side edge being designed and arranged to be seamed in-the-flat to said first side edge when said back panel is in said third flat state and said back of thumb panel is in said fourth flat state;

a palm panel which in a fifth flat state has a fourth side edge, a second half-thumb peripheral edge and a second partial palmar line junction edge, said second half-thumb peripheral edge being designed and arranged to be seamed in-the-flat to said first half-thumb peripheral edge when said back to thumb panel is in said fourth flat state and said palm panel is in said fifth flat state so that said first partial palmar line junction edge and said second partial palmar line junction edge combine to form a substantially straight palmar line junction edge which is designed and arranged to be seamed in-the-flat to the line junction edge of the palmar fingers panel, and wherein said fourth side edge is designed and arranged to be seamed in-the-flat to said second side edge when said palm panel is in said fourth flat state and said back panel is in said third flat state.

10. The handcovering of claim 9 wherein said line junction edge, said dorsal line junction edge and said palmar line junction edge are all of the same length.

11. The hand covering of claim 10 wherein the length each of said line junction edge, said dorsal line junction edge and said palmar line junction edge is approximately eequal to one-half the circumference of the hand to be enclosed in the handcovering.

12. The hand covering of claim 11 and further comprising tabs extending from the line junction edges of the dorsal and palmar fingers panels.

13. A hand covering comprising:

dorsal and palmar fingers panels having peripheral edges, a first line junction edge, and a second line junction edge, said peripheral edges defining a first plurality of half-fingers and a second plurality of half-fingers, said panels having a flat state wherein said first line junction edge assumes a first smoothly curved geometrical configuration and said second line junction edge assumes a second smooth curved geometric configuration, said panels having a non-flat state wherein said first line junction edge assumes a third straight geometrical configuration and said second line junction edge assumes a fourth straight geometrical configuration, and wherein said peripheral edges of said panels are connected together to define a plurality of fingers designed and arranged to receive the fingers of a human hand; and a third portion designed and arranged to receive the thum, back and palm of a human hand, said third portion having a palmar line junction edge which in a flat state assumes said fourth straight geometrical configuration and a dorsal line junction edge which in a flat state assumes said third straight geometrical configuration, wherein said dorsal line junction edge is connected to said first line junction edge and said palmar line junction edge is connected to said second line junction edge.

14. The hand covering of claim 13 comprising:

said panels include a index finger panel and a little finger panel, said index finger panel having a index finger panel longitudinal axis and said little finger panel having a longitudinal axis extending in the same direction as said index finger panel longitudinal axis when in a flat state.

* * * * *